US011353172B2

(12) United States Patent
Moon et al.

(10) Patent No.: US 11,353,172 B2
(45) Date of Patent: Jun. 7, 2022

(54) MODULAR LED LAMP SYSTEM

(71) Applicants: Brian Moon, Kennesaw, GA (US); John Luhrs, Marietta, GA (US)

(72) Inventors: Brian Moon, Kennesaw, GA (US); John Luhrs, Marietta, GA (US)

( * ) Notice: Subject to any disclaimer, the term of this patent is extended or adjusted under 35 U.S.C. 154(b) by 0 days.

(21) Appl. No.: 17/284,623

(22) PCT Filed: Oct. 15, 2018

(86) PCT No.: PCT/US2018/055835

§ 371 (c)(1),
(2) Date: Apr. 12, 2021

(87) PCT Pub. No.: WO2020/081045

PCT Pub. Date: Apr. 23, 2020

(65) Prior Publication Data

US 2021/0341111 A1 Nov. 4, 2021

(51) Int. Cl.

| | |
|---|---|
| ***F21S 2/00*** | (2016.01) |
| ***F21V 29/67*** | (2015.01) |
| ***F21V 29/77*** | (2015.01) |
| ***F21V 7/04*** | (2006.01) |
| ***F21V 23/00*** | (2015.01) |
| ***F21V 23/06*** | (2006.01) |
| ***F21Y 115/10*** | (2016.01) |

(52) U.S. Cl.

CPC ..... *F21S 2/005* (2013.01); *F21V 7/04* (2013.01); *F21V 23/003* (2013.01); *F21V 23/06* (2013.01); *F21V 29/67* (2015.01); *F21V 29/773* (2015.01); *F21Y 2115/10* (2016.08)

(58) Field of Classification Search

CPC ..... F21S 2/005; F21V 29/67; F21V 29/773; F21V 7/04; F21V 23/003; F21V 23/06

USPC ..... 362/296.01

See application file for complete search history.

(56) References Cited

U.S. PATENT DOCUMENTS

| | | | | |
|---|---|---|---|---|
| 9,657,934 | B2 * | 5/2017 | Xiong | F21V 23/006 |
| 9,763,312 | B2 * | 9/2017 | Peng | H05B 45/10 |
| 10,551,015 | B2 * | 2/2020 | Romano | F21S 2/005 |

(Continued)

FOREIGN PATENT DOCUMENTS

| | | |
|---|---|---|
| CN | 203010256 | 6/2013 |
| CN | 205859928 | 1/2017 |
| EP | 2444724 A1 | 4/2012 |

OTHER PUBLICATIONS

Written Opinion dated Dec. 27, 2018.
International Search Report dated Dec. 27, 2018.
Supplementary European Search Report dated Apr. 7, 2022.

*Primary Examiner* — Bryon T Gyllstrom
(74) *Attorney, Agent, or Firm* — Thomas Horstemeyer, LLP

(57) ABSTRACT

The disclosure relates to a light-emitting diode (LED) lamp system and apparatus. In one embodiment, an apparatus includes an LED unit. The apparatus includes a heat dissipation assembly and an LED driver assembly. The LED driver assembly includes an LED driver unit and a driver mounting plate. The LED driver unit is electrically coupled with the LED unit. A casing assembly secures the heat dissipation assembly anterior to the LED driver assembly. The casing assembly includes a first longitudinal section and a second longitudinal section that fit together to secure the heat dissipation assembly anterior to the LED driver assembly.

20 Claims, 16 Drawing Sheets

(56) References Cited

U.S. PATENT DOCUMENTS

| | | | | |
|---|---|---|---|---|
| 10,551,726 | B2 * | 2/2020 | Watanabe | G03B 21/16 |
| 2013/0051021 | A1 * | 2/2013 | Fu | F21V 3/00 362/249.02 |
| 2013/0207542 | A1 * | 8/2013 | Watanabe | F21V 29/507 315/32 |
| 2013/0335965 | A1 | 12/2013 | Stefanoff | |
| 2014/0254177 | A1 | 9/2014 | Danesh | |
| 2016/0319996 | A1 * | 11/2016 | Moon | F21S 8/02 |
| 2017/0307181 | A1 | 10/2017 | Engle et al. | |

* cited by examiner

MODULAR LED LAMP SYSTEM

CROSS-REFERENCE TO RELATED APPLICATION

This application is the 35 U.S.C. § 371 national stage application of PCT Application No. PCT/US2018/055835, filed on Oct. 15, 2018, and entitled "MODULAR LED LAMP SYSTEM". The entire content of this application is incorporated by reference herein.

BACKGROUND OF THE INVENTION

Light emitting diode (LED) lamps are only good for the intended socket they are designed for. Tungsten lamps have this same issue. A PAR56 system with a sheet metal housing with a base connector or an integrated reflector and lens would only be able to function in a fixture that was designed to be used with that particular system. LED lamps are the same. A PAR38 LED System is only designed to go into a PAR38 fixture, even though it could go into a standard lamp, as does an A19. High-power LED lamps are designed currently to go into a single lamp socket without having the means to fit into an existing lamp fixture. A complete redesign of the lamp itself would be required.

BRIEF DESCRIPTION OF THE DRAWINGS

Similar reference characters denote corresponding features consistently throughout the attached drawings.

SUMMARY

Figure 1:
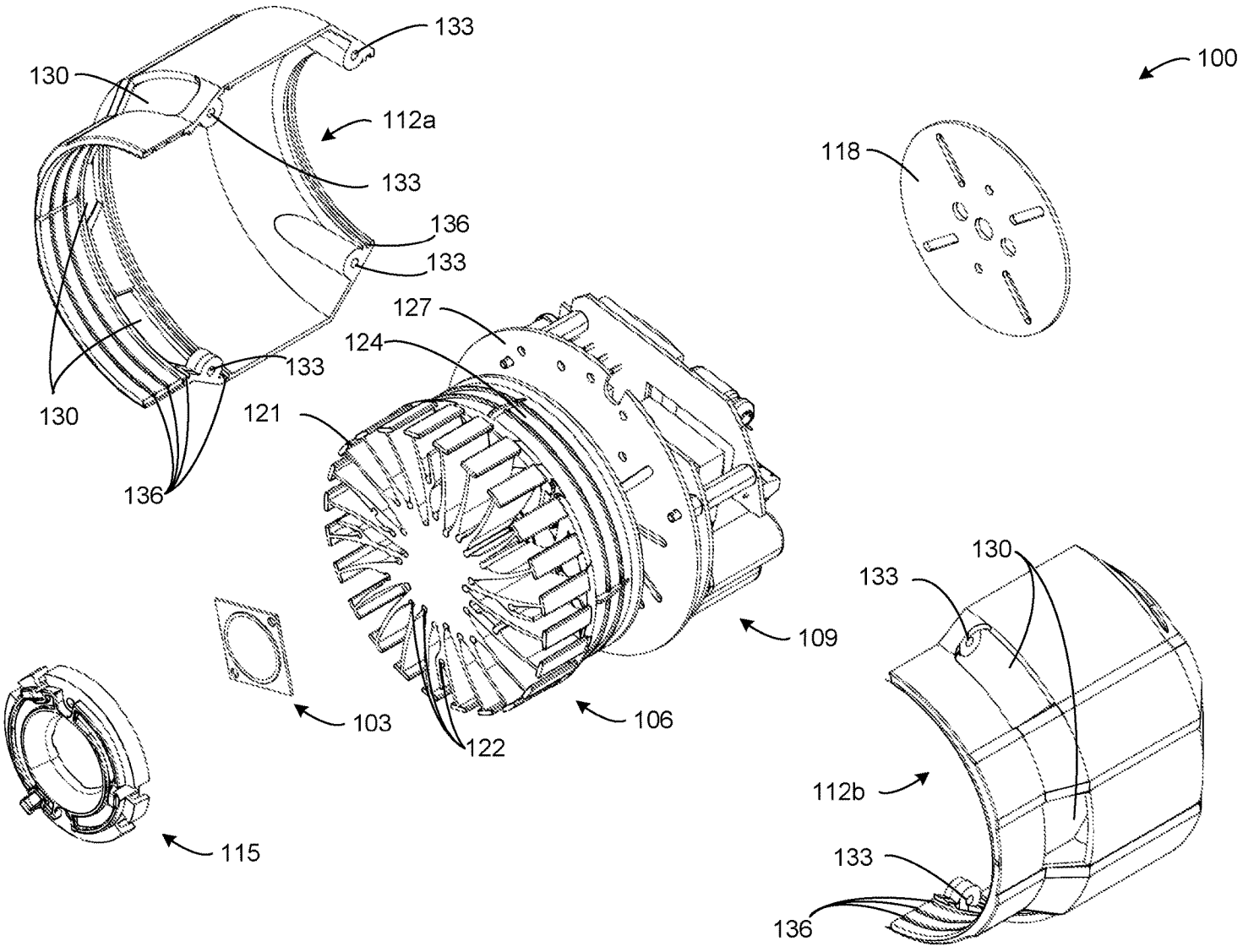
FIG. 1 is a drawings that shows an explosion view of an example modular LED lamp system according to the present disclosure.

In some embodiments of the present disclosure, a lamp system can include a light-emitting diode (LED) unit, a heat dissipation assembly, an LED driver assembly, an electrical connection mounting plate, and a casing assembly. The LED unit can include at least one LED, and can be coupled to an anterior portion of the heat dissipation assembly. The heat dissipation assembly can include a substantially circular ridge. At least a portion of the ridge can be curved with a particular radius of curvature, but the ridge can also include flat portions, notches, and the like. In some cases, the LED driver assembly can include an LED driver unit and a driver mounting plate. The LED driver unit can be electrically coupled with the LED unit. In some cases, the casing assembly can include a first longitudinal half and a second longitudinal half. Each of the longitudinal halves can include a first indent that holds a posterior portion of the heat dissipation assembly, a second indent that holds the driver mounting plate, and a third indent that holds the electrical connection mounting plate, for example, when the first longitudinal half is secured to the second longitudinal half.

In some embodiments, a lamp base can be coupled to the electrical connection mounting plate. The lamp base can be a bayonet base, a mogul base, or a screw base. In some embodiments, power wiring can be guided through at least one hole in the electrical connection mounting plate. In some embodiments, the casing assembly can maintain a thermal barrier between the heat dissipation assembly and the LED driver assembly. In some embodiments, a trim plate can be coupled to an anterior portion of the heat dissipation assembly. The trim plate can include a planar member, and an outer edge of the trim plate can be substantially circular. At least a portion of an outer circumference of the trim plate can be curved with a particular radius of curvature. In some embodiments, the LED driver unit comprises phase dimmer circuitry.

In some embodiments, an optics assembly comprises an optics holder coupled to an anterior portion of the heat dissipation assembly, and the optics holder can secure the LED unit within a recessed portion of the heat dissipation assembly. A light reflector can be coupled to an anterior portion of the optics holder. In some embodiments, the heat dissipation assembly can include a heat sink, and a fan assembly. The fan assembly can include the at least one substantially circular ridge. In further embodiments, the heat dissipation assembly comprises a heat sink and a mounting plate, and the mounting plate can include the at least one substantially circular ridge. At least a portion of an outer circumference of the ridge can be curved with a particular radius of curvature. In some embodiments, the heat dissipation assembly can include a fan assembly, and the casing assembly can include at least one ventilation hole between the fan assembly and the LED driver assembly.

In some embodiments and apparatus can include an LED unit, a heat dissipation assembly, an LED driver assembly, and a casing assembly that secures the heat dissipation assembly a fixed distance anterior to the LED driver assembly. The LED unit can include at least one LED. The LED driver assembly comprising an LED driver unit and a driver mounting plate, wherein the LED driver unit is electrically coupled with the LED unit. The casing assembly can include a first longitudinal section and a second longitudinal section. The casing assembly can provide an engineering fit around the driver mounting plate and at least a portion of the heat dissipation assembly based on the first longitudinal section being coupled to the second longitudinal section. In some examples, the heat dissipation assembly can include a heat dissipation mounting plate, and the casing assembly can provide an engineering fit around the heat dissipation mounting plate.

In some embodiments, an electrical connection mounting plate can be included. The casing assembly can secure the LED driver assembly anterior to the electrical connection mounting plate. The casing assembly can provide an engineering fit around the electrical connection mounting plate.

In some embodiments, a screw base can be coupled to the electrical connection mounting plate. In some embodiments, power wiring is guided through at least one hole in the electrical connection mounting plate. In some embodiments, the casing assembly can maintain a thermal barrier between the heat dissipation assembly and the LED driver assembly. In some embodiments, a trim plate can be coupled to an anterior portion of the heat dissipation assembly. The trim plate can include a planar member comprising a substantially circular outer circumference. At least a portion of an outer circumference of the can be curved with a particular radius of curvature. In some embodiments, a trim plate assembly can include a first planar member coupled to an anterior portion of the heat dissipation assembly, a plurality of spacing members, and a secondary planar member connected to the first planar member using the spacing members. The first planar member can include a substantially circular outer circumference. The second planar member can include a substantially circular outer circumference and a substantially circular inner circumference.

In some embodiments, an optics assembly can include an optics holder coupled to an anterior portion of the heat dissipation assembly, and a light reflector coupled to an anterior portion of the optics holder. The optics holder can secure the LED unit within a recessed portion of the heat dissipation assembly. In some embodiments the heat dissipation assembly can include a fan assembly, and the casing assembly can include at least one ventilation hole between the fan assembly and the LED driver assembly. In some embodiments a yoke mount assembly can include a yoke mount adapter and a yoke coupled to a first tab and a second tab of the yoke mount adapter. The yoke mount adapter can include a face coupled to an anterior portion of the heat dissipation assembly, a first tab that extends perpendicular to the face, and a second tab that extends perpendicular to the face and parallel to the first tab.

DETAILED DESCRIPTION

The present disclosure relates to lighting systems, and more particularly, to a modular LED lamp system. In some cases, the modular LED lamp system can be used as a retrofit lamp system. For example, a single modular LED lamp system can be designed to be configurable so that it can be utilized in a number of different existing lamp fixtures. The retrofit configurations can transform inefficient incandescent fixtures into energy efficient LED fixtures.

Among the various embodiments, multiple different sized packages can include various wattages and form factors. Heat dissipation can including passive and active cooling for LED lighting units. Various lamp bases can also be utilized, for example, to fit into existing lamp fixtures.

Base types can include screw bases, prong bases, and bayonet bases. Bare ends wiring or other custom wiring ends can also be used for power connections. Screw bases can include right handed and left handed screw bases, Edison bases including E26 and E11, among others. Screw bases can be referred to as candelabra bases, intermediate bases, medium or standard bases, and mogul or large bases, for example, based on the size and other factors. For example, E11 can be referred to as mini-candelabra or candelabra screw base. E12 can be referred to as a candelabra screw base. E14 can be referred to as a European screw base. E17 can be referred to as an intermediate screw base. E26 and E27 can each be referred to as a standard or medium screw base. E39 and E40 can each be referred to as a mogul screw base. Other screw bases can also be used. The numbers, for example, in E11, E12, E14, and so on, can refer to diameter in millimeters.

Bayonet bases can include single contact bayonet bases, double contact bayonet bases, indexed or offset bayonet bases, and others. For example, BA15S can refer to a single contact bayonet base. BA15D can refer to a double contact bayonet base. BAY22 can refer to a double contact bayonet base. Other bayonet bases can also be used. The numbers, for example, in BA15S, BAY22, and so on, can refer to diameter in millimeters.

Optics types for fixtures can also vary. The various embodiments can have optics attachments or optics adapters for wash light optics, profile or Gobo projector optics, beam projector optics, varying zoom wash light optics, and others. Wash light optics can have ability for beam shaping via barndoors, honeycomb filter, gel filters (color filters) and other types of accessories. Profile or Gobo Projector optics can have the ability to projector hard edge, focusable, beam of light, with either single degree beams or a varying degree lens system. Profile optics can also project gobo patterns and can use a condensing lens system for producing brighter spot with high efficiency. The lens system can include a plano convex lens stack or aspheric lens. A slot can also be provided in the system for gobo to mount into. Beam Projector optics can produce a narrow beam for long throw applications. One example can be an RLT lens to create this beam effect. Optics can also project gobo patterns and can use a condensing lens system for producing brighter spot with high efficiency. The lens system can include a plano convex lens stack or aspheric lens. A varying zoom wash fixture can include a Fresnel lens attachment for the fixture can be adjusted to make a size of the beam bigger or smaller depending on the EFL from the LED Source. Each of the optics packages for the lamp system can be utilized along with an accessory holder to mount top hats, half hats, louvres, honeycomb filters, gel filters, and barndoors. Further, each fixture can also come in a track mount via a track adapter from specific track light manufacturers, as well as a canopy mount where it mounts directly to an electrical junction box, or can mount to a structure using c-clamp, pipe adapter, and/or strut channel.

The LED lamps can also be retrofits for stage lighting. Types of stage lighting retrofit fixture applications can include: Altman 360Q Ellispoidal, ETC Source 4 Ellipsoidal, Altman Phoenix, Altman 360Q, stage Fresnel fixtures, other hard edge fixtures, focused gobo projector fixtures, profile fixtures, PAR 56 AND 64 stage light fixtures including Source 4 PAR from ETC, ALTMAN Star Par, Altman PAR 56 or 64. Each of these applications can be used with different sized engines depending on factors including form factor of existing fixtures, size of the unit it is going into, the required lumen package, as well as desired optics.

The LED lamp systems can also include dimmable drivers that maintain ability to dim while using a variety of dimming systems including 0-10 v dimming, two wire dimming, digital control dimming such as low voltage controls, high voltage controls and other controls. Low Voltage controls can include DMX, such as DMX512B (RS-485 Protocol), DALI, 0-10V Analog, Network, and Wireless Protocols that can include DMX, ZIGBEE, BLUETOOTH, and others. High Voltage Controls can include on/off RELAY DIMMERS, which can include SINEWAVE, SCR, IGBT, FORWARD PHASE, REVERSE PHASE, 3 WIRE DIMMER METHOD, and other systems.

FIG. 1 shows an exploded view of a modular LED lamp system 100 according to the present disclosure. The lamp system 100 can include a light-emitting diode (LED) unit 103, a heat dissipation assembly 106, an LED driver assembly 109, a casing assembly 112 that includes a first longitudinal section 112*a* and a second longitudinal section 112*b*. The lamp system 100 can also include an optics assembly 115, and an electrical connection mounting plate 118. The LED lamp system 100 can be configured as a number of different wattages, such as 300 Watts, 500 Watts, 700 Watts, 1000 Watts, and other wattages above and below these values.

The LED unit 103 can be a high-power single point source emulated LED chip or chip-on-board (COB) LED unit. A single LED unit 103 can include a single LED or multiple LEDs, for example, in an array of LEDs. The LED unit 103 can also include a lens or optical refractors. In other cases, a lens or optical reflector is not part of the LED unit 103. The optics assembly 115 can include external lenses, reflectors, and other components. As shown, the optics assembly 115 can be an optics holder. In some cases, the optics assembly 115 can be coupled to an anterior portion of the heat dissipation assembly 106, and can secure or hold the LED unit 103. In some examples, the LED unit 103 can be held within a recessed portion of the heat dissipation assembly. The optics assembly 115 can also include a light reflector coupled to an anterior portion of the shown optics holder.

The heat dissipation assembly 106 can include passive and/or active elements. For example, the heat dissipation assembly can include a heat sink 121 and a fan assembly 124. The heat sink 121 can include a plurality of attachment points 122, which can include threaded holes, or holes for an interference fit or another engineering fit.

The fan assembly 124 can have a fan and a fan casing with an external shape with a number of ridges around its periphery, which can be substantially circular. The fan casing can also have a number of longitudinal ridges perpendicular to the substantially circular ridges. The casing assembly 112 can have an internal shape that matches the external shape of the fan assembly 124. For example, the casing assembly 112 can include a number of slots or indents 136 that accept the ridges of the fan casing to hold the heat sink assembly 106 when the longitudinal halves 112*a* and 112*b* are adjacently secured around the fan casing.

The LED unit 103, heat dissipation assembly 106, and optics assembly 115 can be referred to as an LED engine. The LED engine can be secured a fixed distance from the LED driver assembly 127 by the casing assembly 112, for example, by securing the longitudinal halves of the casing assembly 112 around the respective parts. In some cases, the heat dissipation assembly 106 can also include a heat dissipation mounting plate, for example, posterior to the other components of the heat dissipation assembly 106 including the fan and/or the heat sink. The LED engine can be secured a fixed distance from the LED driver assembly 127 by the casing assembly 112, for example, by securing the slots or indents 136 of the longitudinal halves of the casing assembly 112 around the heat dissipation mounting plate and the LED driver mounting plate 127. The LED unit 103, once assembled in the LED engine, can be held in front of, or within, the recess shown in the heat sink 121.

The LED driver assembly 109 can include modular circuit boards and may include LED dimmer circuitry, and the like. The LED driver is in operable communication with the LED light engine. The LED driver assembly 109 can also include an LED driver mounting plate 127. The LED driver mounting plate 127 can be substantially circular and planar and can be held can be held by the casing assembly 112 in a slot or indent 136 formed by the longitudinal halves 112*a* and 112*b* when the longitudinal halves 112*a* and 112*b* are adjacently secured. At least a portion of an outer circumference of the LED driver mounting plate 127 can be curved with a particular radius of curvature. The LED driver assembly 109 can be held a fixed distance from the heat dissipation assembly 106 in this way.

The electrical connection mounting plate 118 can be substantially circular and planar and can be held posterior to the LED driver assembly 109 by the casing assembly 112 by a slot or indent 136 when the longitudinal halves 112*a* and 112*b* are adjacently secured. The electrical connection mounting plate 118 can include a plurality of mounting holes that can be used to mount electrical power connections including the screw bases, prong bases, bayonet bases or wiring ends described above. The mounting holes can include circular holes and elongate holes or slots that can provide a variable positioning for bolts and screws. In some cases, the mounting holes can be threaded.

The casing assembly 112 can include casing ventilation holes 130 and casing attachment holes 133 on each of the longitudinal halves 112*a* and 112*b*. In some examples, the casing attachment holes 133 can be threaded. The casing assembly 112 can be made of plastic, such as phenolic plastic. This can provide strength and versatility, as well as prevent heat transfer, for example, between the LED driver assembly 109 and the heat dissipation assembly 106. Metals and other materials can also be used. The casing ventilation holes 130 can vent heat away from both the heat dissipation assembly 106 as well as the LED driver assembly 109. The ventilation holes 130 can be provided between the LED driver assembly 109 and the heat dissipation assembly 106.

The casing assembly 112 can provide an engineering fit around the heat dissipation mounting plate and/or other portion of the heat dissipation assembly 106, the LED driver mounting plate 127 or other portion of the LED driver assembly 106, and the electrical connection mounting plate 118. The casing assembly 112 can do so by providing a slot or indent 136 for each of the components. Engineering fit can refer to any of a clearance fit where the slot or other hole of the casing assembly is larger than the object held therein, a location fit or transition fit where the hole is equal to or slightly smaller than the object held therein (e.g., tight fit, similar fit, fixed fit), or and interference fit, where the hole is smaller than the object held therein.

Figure 2:
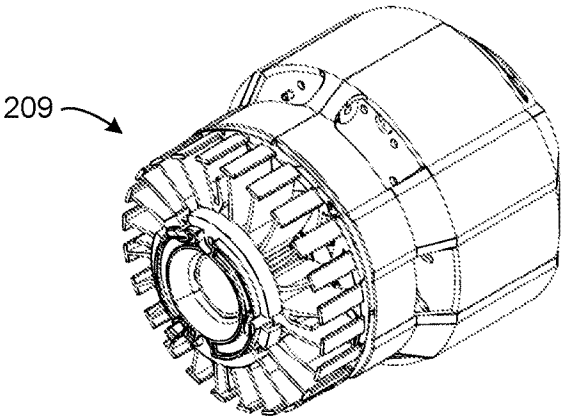
FIG. 2 is a drawing that shows additional views of the modular LED lamp system of FIG. 1, according to the present disclosure.
Figure 2:
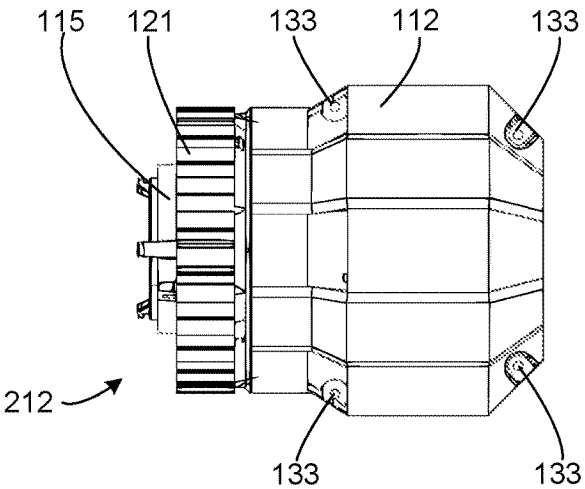
Figure 2:
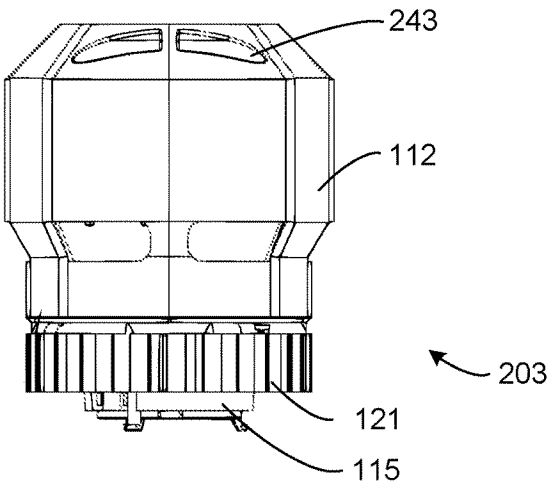
Figure 2:
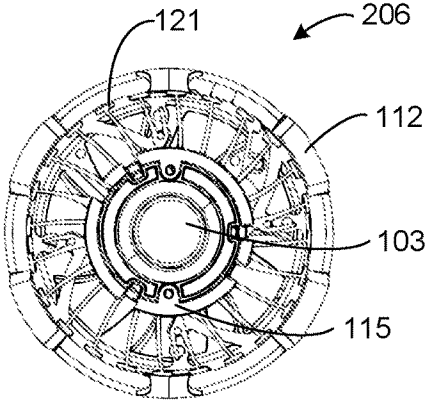

FIGS. 2-8 show views of the modular LED lamp system 100, assembled, and in some cases equipped with additional features. For example, FIG. 2 shows views of the modular LED lamp system 100, including a side view 203, a facing view 206, a perspective view 209, and a side view 212. In FIG. 2, the LED lamp system 100 can be seen as assembled from the exploded view of FIG. 1. In addition to the items described with reference to FIG. 1, posterior casing ventilation holes 243 are shown in the casing assembly 112. The posterior casing ventilation holes 243 can be provided between the LED driver assembly 109 and the electrical connection mounting plate 118.

Figure 3:
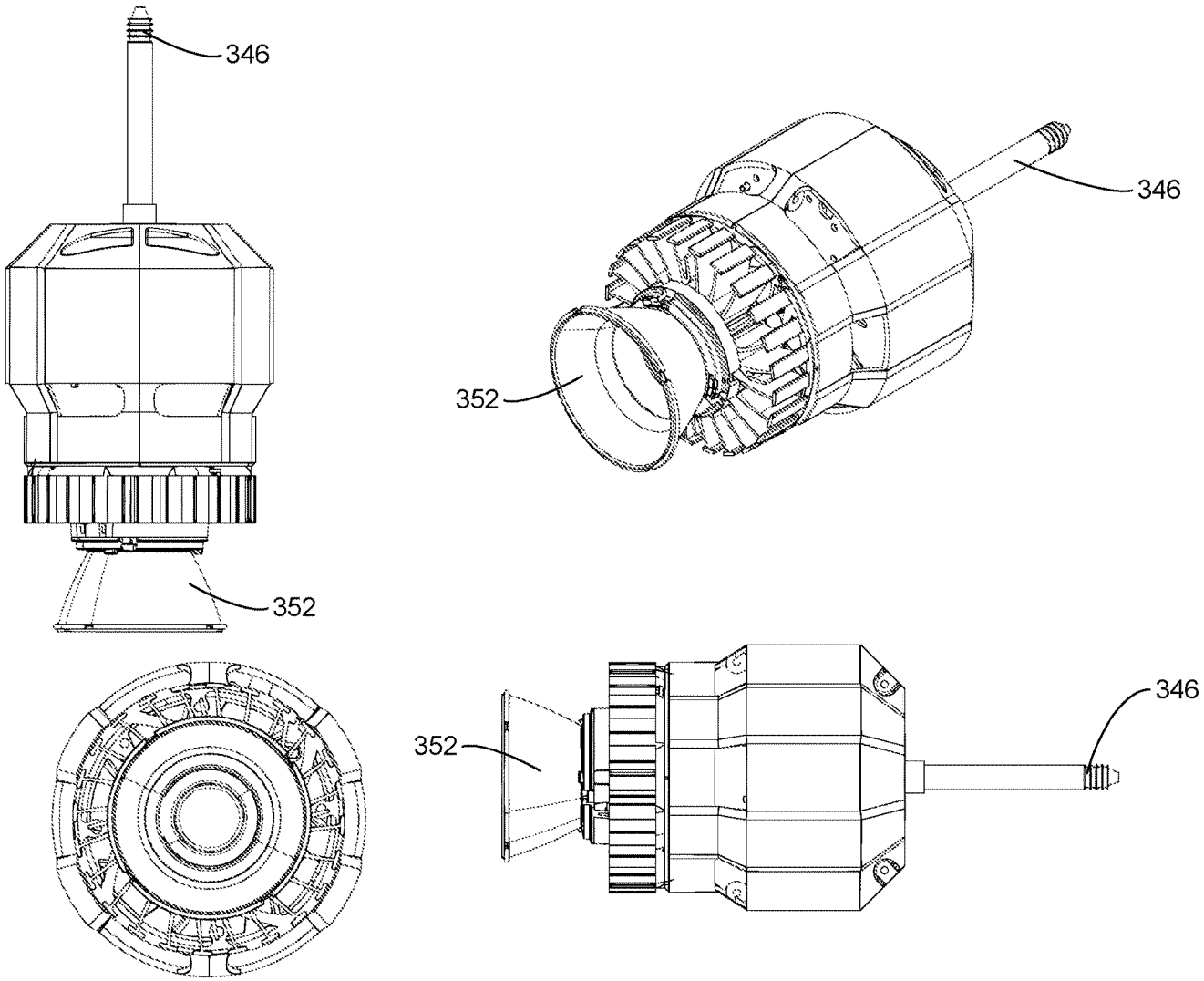
FIGS. 3-9 are drawings that show views of the modular LED lamp system of FIG. 1 equipped with modular additions, according to the present disclosure.

FIG. 3 shows views of a modular LED lamp system 100, equipped with an elongate screw base 346 and a reflector 352. The elongate screw base 346 can be an E11 screw base, an E12 screw base, or any other screw base. The elongate screw base 346 can be an electrical power connection, and can attach or be coupled to the electrical connection mounting plate 118. A length of the elongate screw base 346 can be determined based on a recess for an existing fixture. For example, if the modular LED lamp system 100 is configured to replace the existing fixture in a retrofit application, then a total length of the LED lamp system 100 can be determined to be the same as the depth of the recess. Alternatively, the total length of the LED lamp system 100 can be determined such that all or most of the LED lamp system 100 fits within the recess. Accordingly, the length of the elongate screw base 346 can be determined based on a depth of an existing recess, a length of the basic LED lamp system 100, and a length of the reflector 352.

The reflector 352 can be coupled to the LED optics holder, and can be considered part of the LED optics assembly 115. The reflector 352 can be conical or any other reflector shape, and can use PMMA (poly (methyl methacrylate))-based, silicone-based, or TIR (total internal reflection)-based optics, or aluminum, glass, or anti-reflective glass-based optics.

Figure 4:
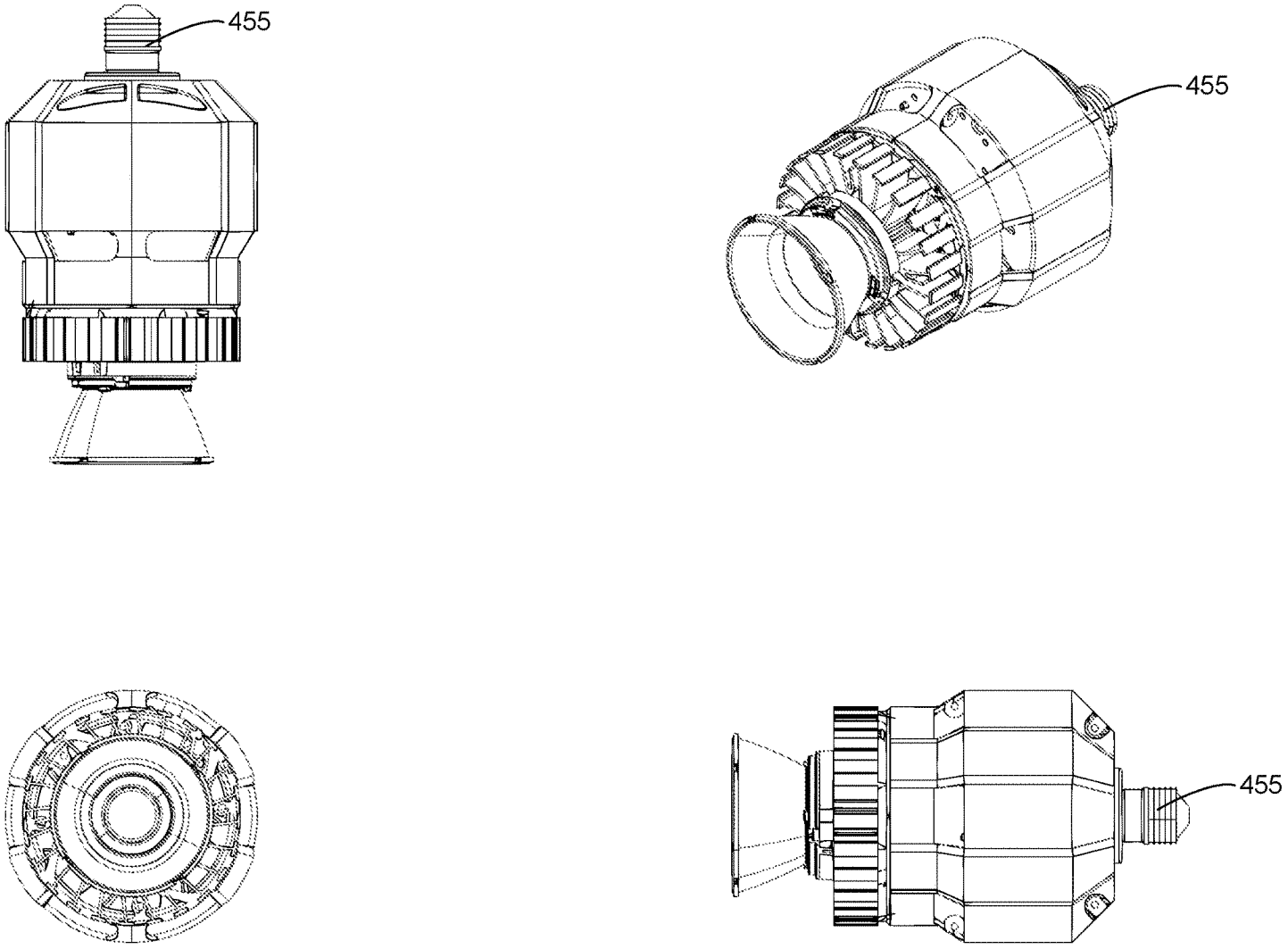

FIG. 4 shows views of a modular LED lamp system 100, equipped with a screw base 455 and a reflector. The reflector can be similar to the reflector 352. The screw base 455 can be an E11 screw base, an E12 screw base, or any other screw base as described. The screw base 455 can be an electrical power connection, and can attach or be coupled to the electrical connection mounting plate 118. As with the elongate screw base 346, the screw base 455 can be chosen based on a recess for an existing fixture. For example, if the modular LED lamp system 100 is configured to replace the existing fixture in a retrofit application, then a total length of the LED lamp system 100 can be determined to be the same as the depth of the recess. Alternatively, the total length of the LED lamp system 100 can be determined such that all or most of the LED lamp system 100 fits within the recess, for example, so that a trim plate or another aesthetic features properly mounts over a face of the recess.

Figure 5:
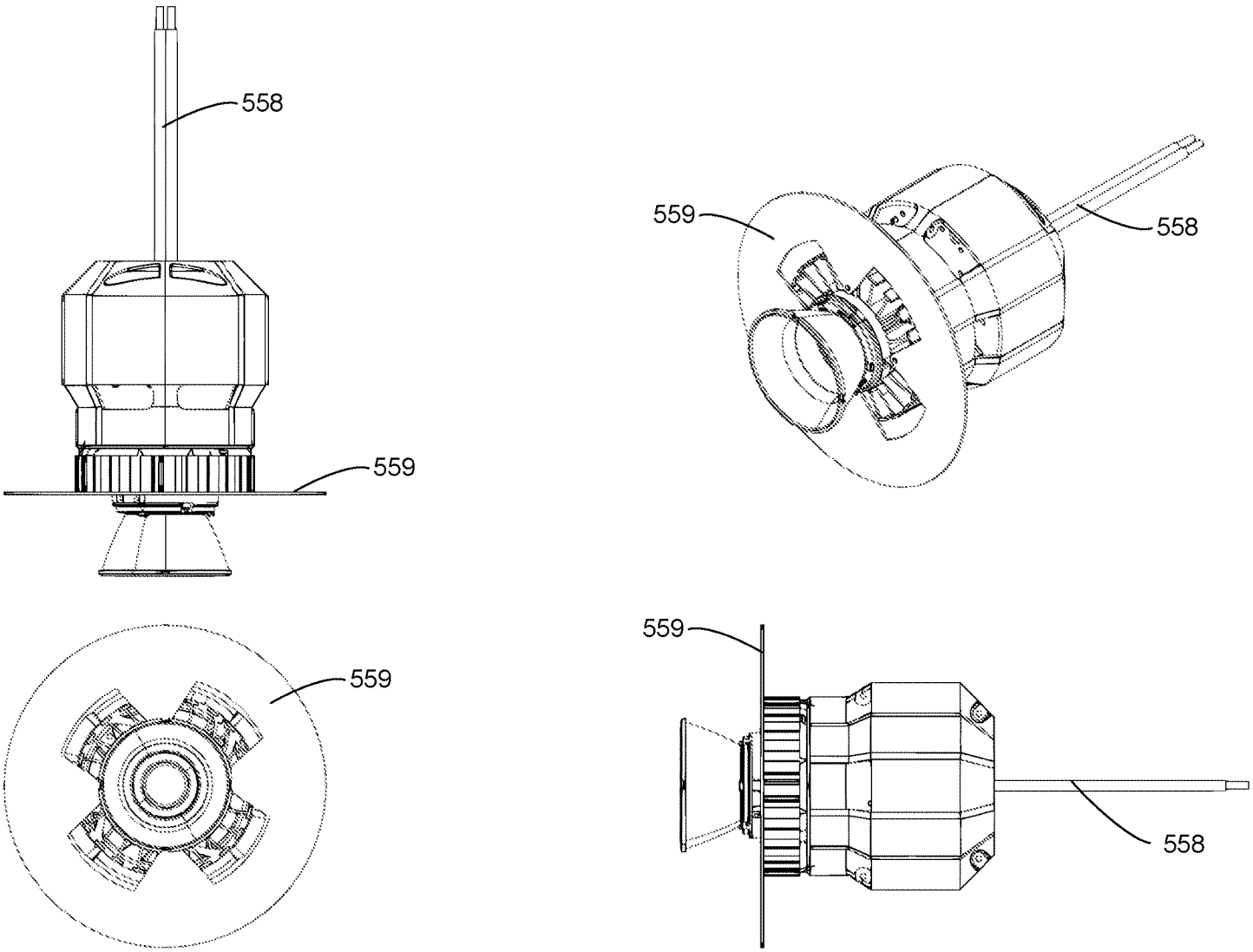

FIG. 5 shows views of a modular LED lamp system 100, equipped with electrical power wiring 558, a trim plate 559, and a reflector. The trim plate can also be referred to as a facing plate. The reflector can be similar to the reflector 352. In some cases the wiring 558 can be held by the electrical connection mounting plate 118, or can extend through the holes or mounting holes of the electrical connection mounting plate 118. The trim plate 559 can be a circular planar member, and can be coupled to the heat sink using mounting holes in the trim plate 559 and the heat sink. In some cases, the trim plate 559 can include ventilation holes so that air can reach the heat dissipation assembly 106, for example, from outside of a recessed area for the LED lamp system 100.

For example, if the modular LED lamp system 100 is configured to replace the existing fixture in a retrofit application, then a total length of the LED lamp system 100 can be determined to be the same as the depth of the recess. Alternatively, the total length of the LED lamp system 100 can be determined such that all or most of the LED lamp system 100 fits within the recess. An outer edge of the trim plate can be substantially circular, or can be any appropriate shape.

Figure 6:
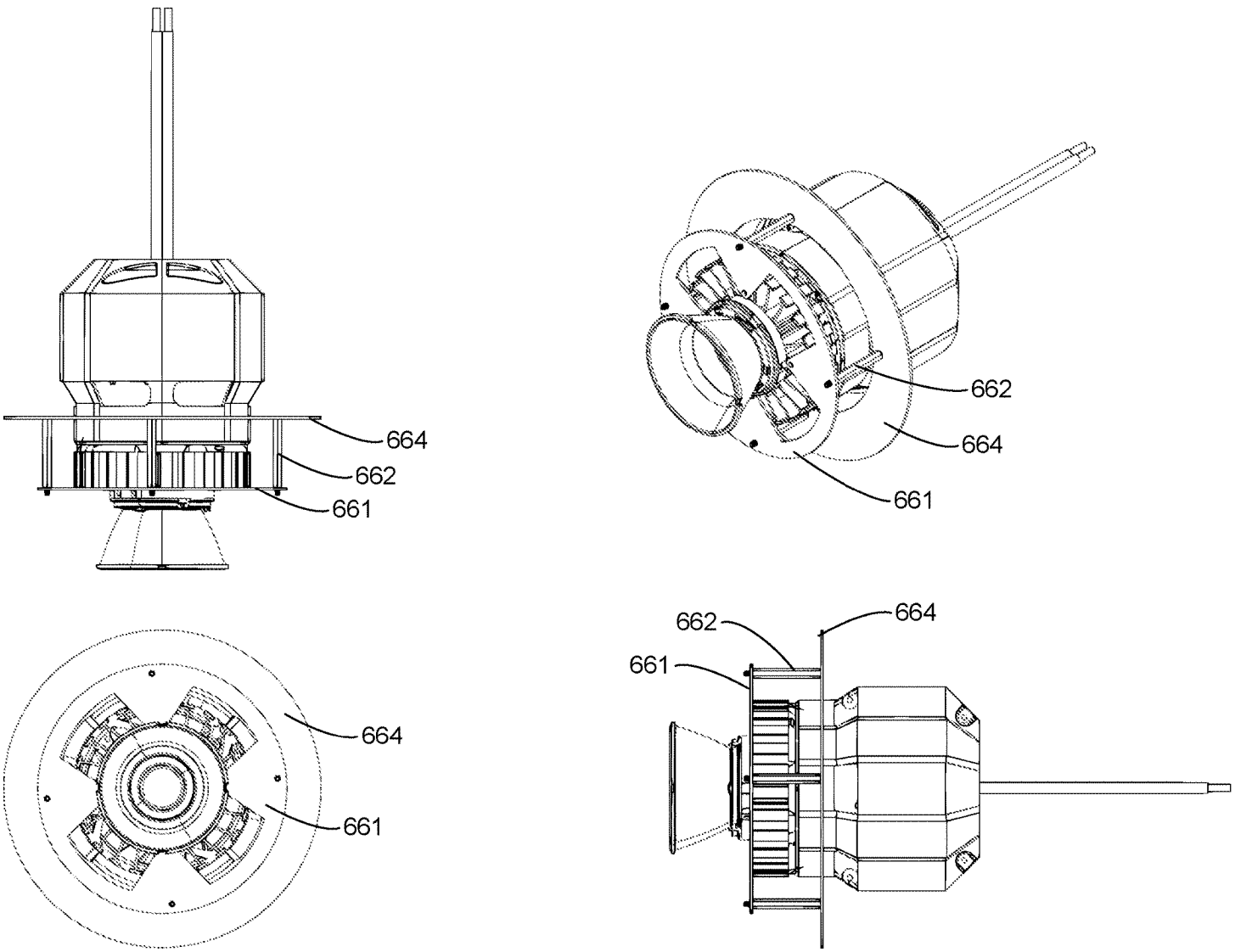

FIG. 6 shows views of a modular LED lamp system 100, equipped with electrical power wiring, a trim plate 661, spacing members 662, and another trim plate 664. The trim plate 661 can include a first planar member coupled to an anterior portion of the heat dissipation assembly 106, for example, using holes in each of the heat sink and the trim plate 661. The spacing members 662 can hold the trim plate 661 a fixed distance from the trim plate 664, for example, to match an existing fixture configuration. This configuration can provide additional ventilation for the heat dissipation assembly 106, as well as provide a different aesthetic. The trim plate 664 can include a planar member that has a substantially circular outer circumference and a substantially circular inner circumference. The inner circumference of the trim plate 664 can be equal to or larger than an outer circumference of the casing assembly 112, so that it can fit around the casing assembly 112. The outer circumference of the trim plate 664 can be chosen or determined based on a width of a recess for an existing fixture, or based on other considerations.

Figure 7:
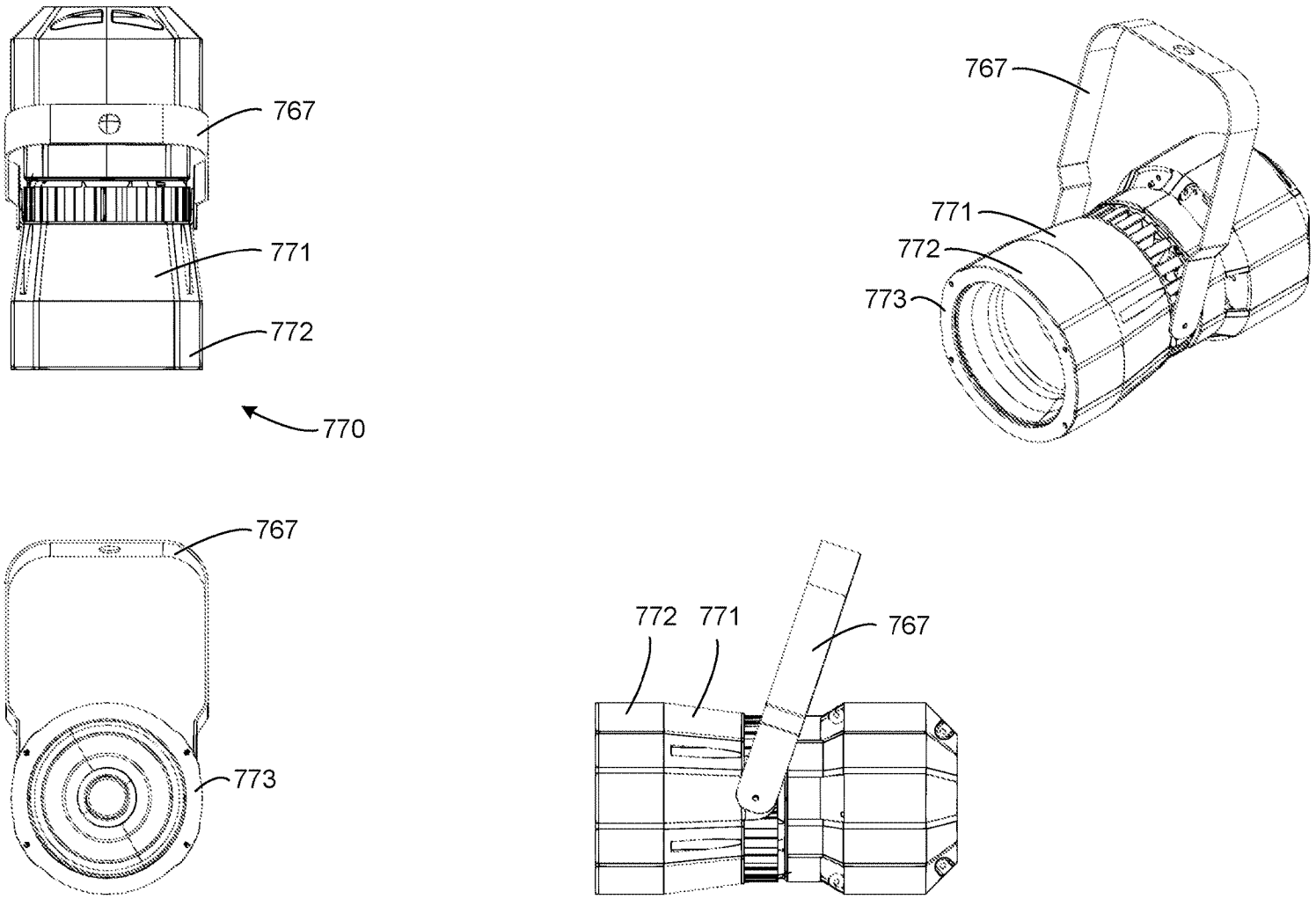

FIG. 7 shows views of a modular LED lamp system 100, equipped with a yoke mount 767 and an accessory adapter assembly 770. The yoke mount 767 is discussed further in FIG. 9. The accessory adapter assembly 770 can include a long accessory shroud that includes a short accessory shroud 771, a shroud extension 772, and a cover 773. The cover 773 can be an aesthetic cover, and/or can be an accessory holder for the accessories discussed above, including top hats, half hats, louvres, honeycomb filters, gel filters, and barndoors.

Figure 8:
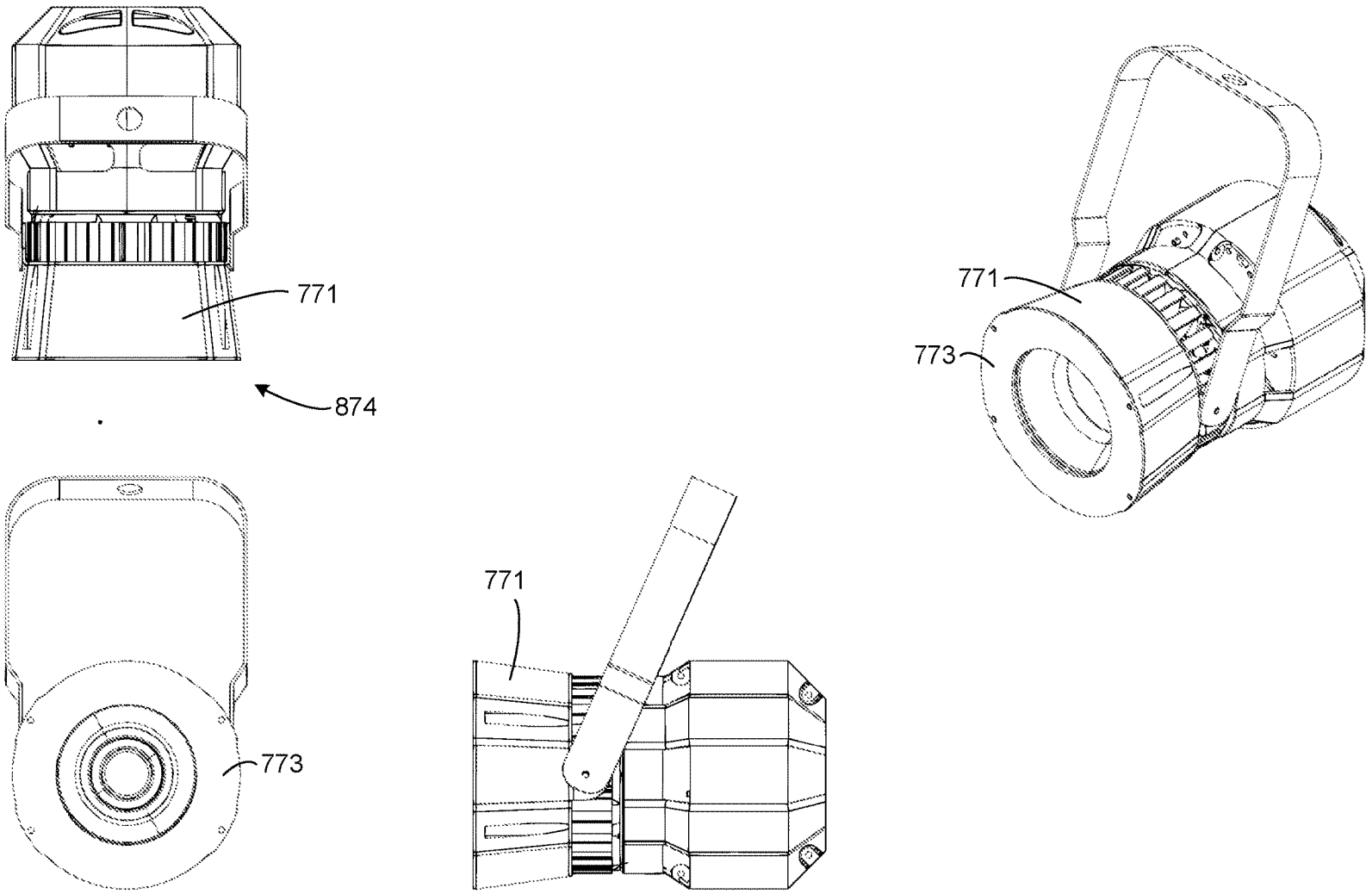

FIG. 8 shows views of a modular LED lamp system 100, equipped with a yoke mount and an accessory adapter assembly 874. The yoke mount is discussed further in FIG. 9. The accessory adapter assembly 770 can include a short accessory shroud 771 and the cover 773, as discussed above for FIG. 7.

Figure 9:
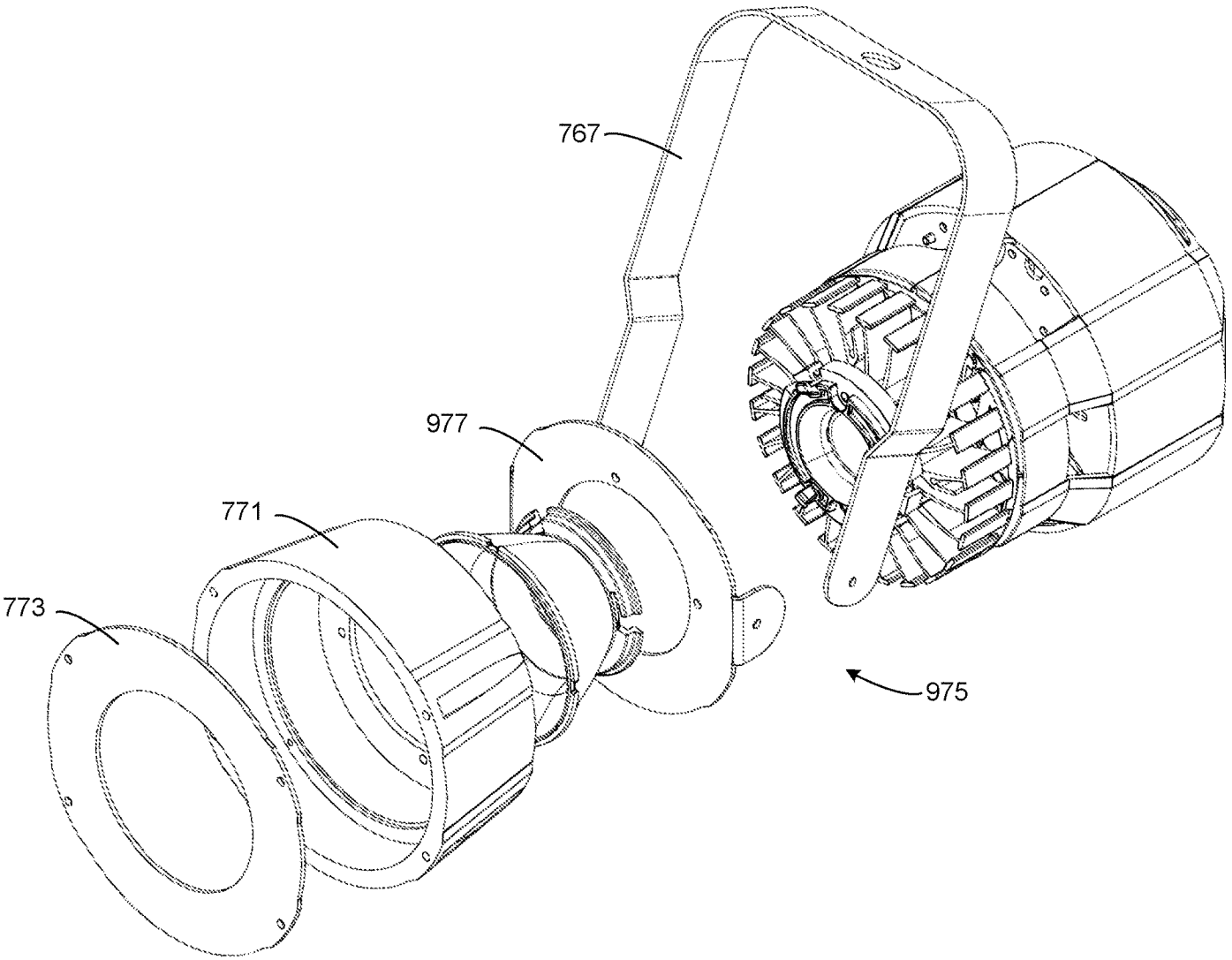

FIG. 9 shows an exploded view of a modular LED lamp system 100, equipped with a yoke mount assembly 975, and the accessory adapter assembly 874. FIG. 9 can represent an exploded view of the lamp system 100 shown configured as in FIG. 8. The accessory adapter assembly 770 can include a short accessory shroud 771 and the cover 773, as discussed above for FIG. 7. The yoke mount assembly 975 can include the yoke mount 767, and a yoke mount adapter 977. The yoke mount assembly 975 can be used to mount the modular LED lamp system 100 for track lighting by connecting to a track lighting system.

The yoke mount adapter 977 can include a face coupled to an anterior portion of the heat dissipation assembly 106, a first tab that extends perpendicular to the face, and a second tab that extends perpendicular to the face and parallel to the first tab. The yoke mount adapter 977 can be an accessory holder as well. For example, the yoke mount adapter 977 can hold top hats, half hats, louvres, honeycomb filters, gel filters, and barndoors. Alternatively, the short accessory shroud 771, and the cover 773, can be coupled to the anterior of the yoke mount adapter 977. In some cases, the yoke mount adapter 977 can have a circular interior edge or another interior opening larger than an exterior or periphery of the optics holder 115.

FIGS. 10-16 show views of another modular LED lamp system 1000. By contrast with FIGS. 1-9, the modular LED lamp system 1000 can be smaller, and can be passively cooled. While shown with passive cooling, the heat dissipation can include passive and active cooling as described for the modular LED lamp system 100 of FIGS. 1-9. The features described for each of these modular lamp systems 100 and 100 are understood to be interoperable.

Figure 10:
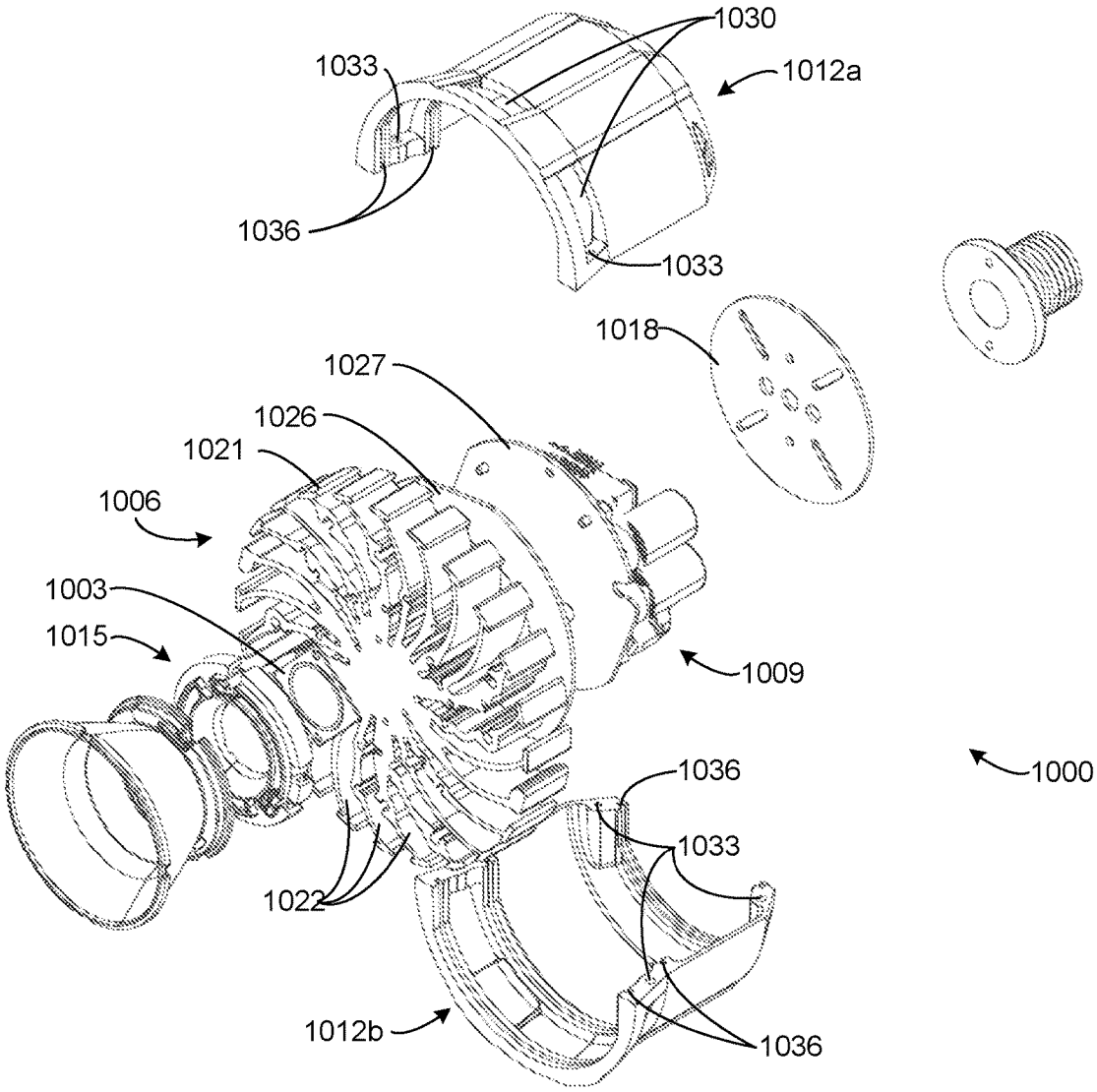
FIG. 10 is a drawings that shows an explosion view of another example modular LED lamp system according to the present disclosure.

FIG. 10 shows an exploded view of a modular LED lamp system 1000 according to the present disclosure. The lamp system 1000 can include a light-emitting diode (LED) unit 1003, a heat dissipation assembly 1006, an LED driver assembly 1009, a casing assembly 1012 that includes a first longitudinal section 1012*a* and a second longitudinal section 1012*b*. The lamp system 1000 can also include an optics assembly 115, and an electrical connection mounting plate 1018. The LED lamp system 1000 can be configured as a number of different wattages, such as 150 Watts, 100 Watts, and other wattages above and below these values.

The LED unit 1003 can be a high-power single point source emulated LED chip or chip-on-board (COB) LED unit. A single LED unit 1003 can include a single LED or multiple LEDs, for example, in an array of LEDs. The LED unit 1003 can also include a lens or optical refractors. In other cases, a lens or optical reflector is not part of the LED unit 1003. The optics assembly 1015 can include external lenses, reflectors, and other components. As shown, the optics assembly 1015 can be an optics holder. In some cases, the optics assembly 1015 can be coupled to an anterior portion of the heat dissipation assembly 106, and can secure or hold the LED unit 1003. In some examples, the LED unit 1003 can be held within a recessed portion of the heat dissipation assembly, such as a recess of the heat sink 1021. The optics assembly 1015 can also include a light reflector coupled to an anterior portion of the shown optics holder.

The heat dissipation assembly 1006 can include passive and/or active elements. For example, the heat dissipation assembly can include a heat sink 1021. The heat sink 1021 can include a plurality of attachment points, which can include threaded holes, or holes for an interference fit or another engineering fit. The heat sink 1021 can be considered a short heat sink, and can have a diameter that is greater than a diameter of the assembled casing assembly 1021. In some cases, a fan assembly can also be included. The heat dissipation assembly can also include a heat dissipation mounting plate 1026.

The LED unit 1003, heat dissipation assembly 1006, and optics assembly 1015 can be referred to as an LED engine. The LED engine can be secured a fixed distance from the LED driver assembly 1027 by the casing assembly 1012, for example, by securing the longitudinal halves of the casing assembly 1012 around the respective parts. The heat dissipation mounting plate 1026 can be posterior to the other components of the heat dissipation assembly 1006 including the fan and/or the heat sink. The LED engine can be secured a fixed distance from the LED driver assembly 1027 by the casing assembly 1012, for example, by securing the slots or indents 136 of the longitudinal halves of the casing assembly 1012 around the heat dissipation mounting plate 1026 and the LED driver mounting plate 1027. The LED unit 1003, once assembled in the LED engine, can be held in front of, or within, the recess shown in the heat sink 1021.

The LED driver assembly 1009 can include modular circuit boards and may include LED dimmer circuitry, and the like. The LED driver is in operable communication with the LED light engine. The LED driver assembly 1009 can also include an LED driver mounting plate 1027. The LED driver mounting plate 1027 can include a portion of the periphery that is rounded with a particular radius of curvature, while another portion of the periphery is flattened. This shape can prevent rotation of the plate when held by the casing assembly. In addition, the LED driver mounting plate 1027 can include a notch as shown, and the slot 1036 or the casing 1012 can have a protrusion into the notch. Any of the mounting plates 1026, 1027, 1018, 127, and 118 described herein can include these flattened or notched portions. The slots 1036 can have matching flattened portions, and/or matching protrusions to fit in a notched portion, in order to accommodate such mounting plates. LED driver mounting plate 1027 can be held by the casing assembly 1012 in a slot or indent 1036 formed by the longitudinal halves 1012*a* and 1012*b* when the longitudinal halves 1012*a* and 1012*b* are adjacently secured. The LED driver assembly 1009 can be held a fixed distance from the heat dissipation assembly 1006 in this way.

The electrical connection mounting plate 1018 can be substantially circular and planar. The electrical connection mounting plate 1018 can be held posterior to the LED driver assembly 1009 by the casing assembly 1012 by a slot or indent 1036 when the longitudinal halves 1012*a* and 1012*b* are adjacently secured. The electrical connection mounting plate 1018 can include a plurality of mounting holes that can be used to mount electrical power connections including the screw bases, prong bases, bayonet bases or wiring ends described above. The mounting holes can include circular holes and elongate holes or slots that can provide a variable positioning for bolts and screws. In some cases, the mounting holes can be threaded.

The casing assembly 1012 can include casing ventilation holes 1030 and casing attachment holes 1033 on each of the longitudinal halves 1012*a* and 1012*b*. In some examples, the casing attachment holes 1033 can be threaded. The casing assembly 1012 can be made of plastic, such as phenolic plastic. This can provide strength and versatility, as well as prevent heat transfer, for example, between the LED driver assembly 1009 and the heat dissipation assembly 1006. Metals and other materials can also be used. The casing ventilation holes 1030 can vent heat away from both the heat dissipation assembly 1006 as well as the LED driver assembly 1009. The ventilation holes 1030 can be provided between the LED driver assembly 1009 and the heat dissipation assembly 1006.

The casing assembly 1012 can provide an engineering fit around the heat dissipation mounting plate and/or other portion of the heat dissipation assembly 1006, the LED driver mounting plate 1027 or other portion of the LED driver assembly 1006, and the electrical connection mounting plate 1018. The casing assembly 1012 can do so by providing a slot or indent 1036 for each of the components. Engineering fit can refer to any of a clearance fit where the slot or other hole of the casing assembly is larger than the object held therein, a location fit or transition fit where the hole is equal to or slightly smaller than the object held therein (e.g., tight fit, similar fit, fixed fit), or and interference fit, where the hole is smaller than the object held therein.

Figure 11:
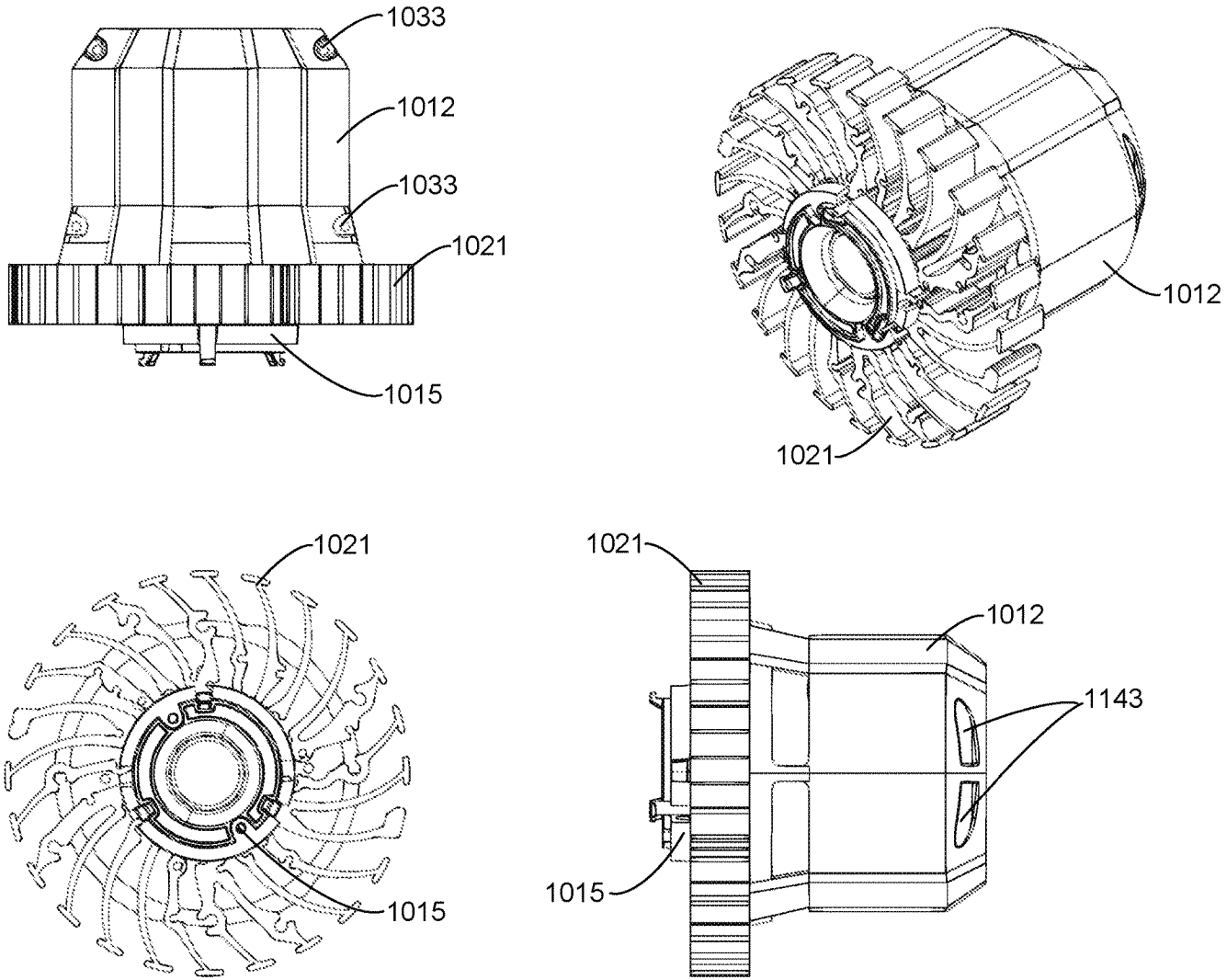
FIG. 11 is a drawing that shows additional views of the modular LED lamp system of FIG. 10, according to the present disclosure.
Figure 12:
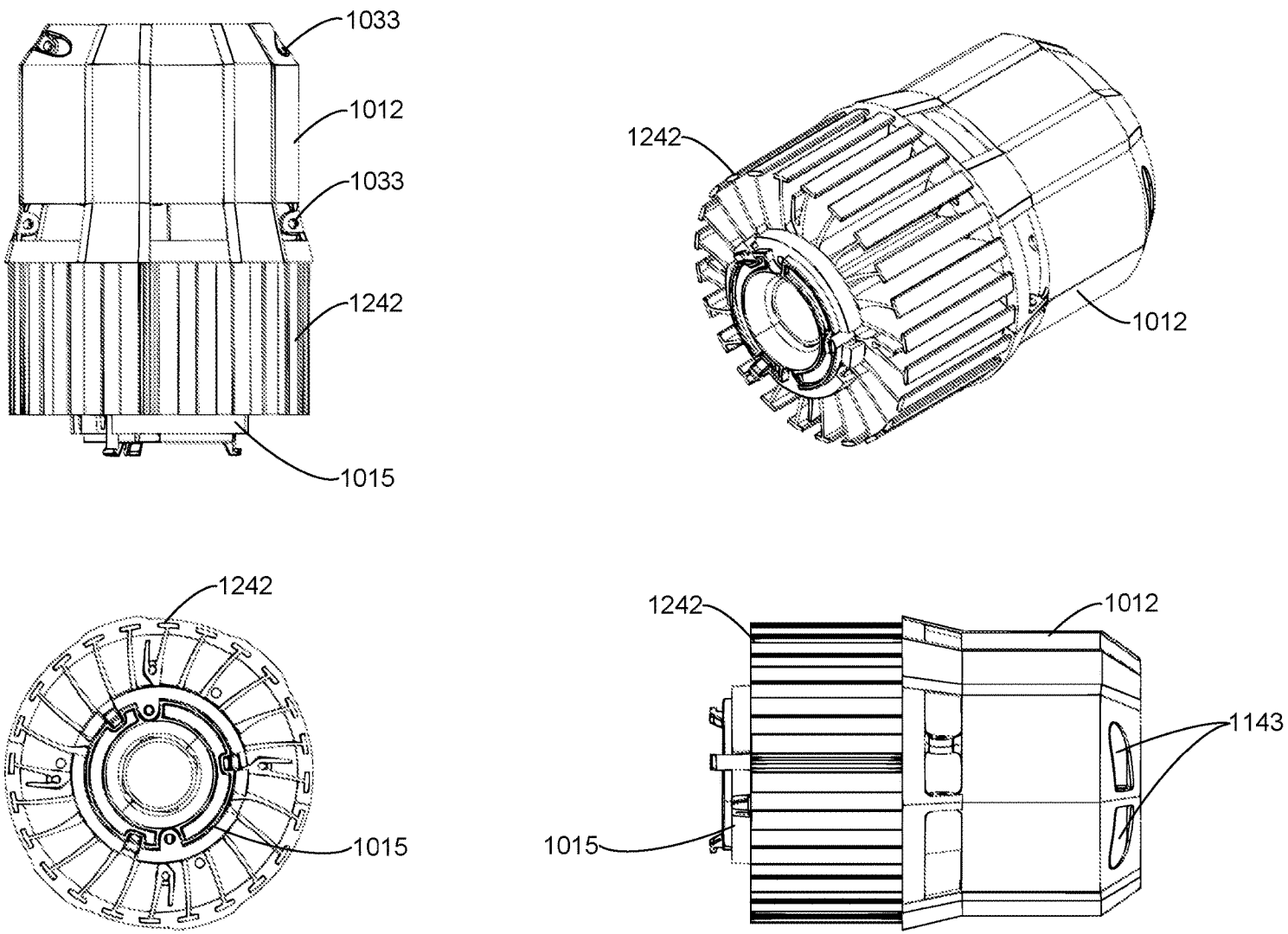
FIGS. 12-16 are drawings that show views of the modular LED lamp system of FIG. 10 equipped with modular additions, according to the present disclosure.

FIGS. 11-16 show views of the modular LED lamp system 1000, assembled, and in some cases equipped with additional features. For example, FIG. 11 shows views of the modular LED lamp system 1000. In FIG. 2, the LED lamp system 1000 can be seen as assembled from the exploded view of FIG. 10. In addition to the items described with reference to FIG. 10, posterior casing ventilation holes 1143 are shown in the casing assembly 1012. The posterior casing ventilation holes 1143 can be provided between the LED driver assembly 1009 and the electrical connection mounting plate 1018. FIG. 12 shows views of a modular LED lamp system 1000, equipped with a long heat sink 1242. The long heat sink 1242 can have a diameter that is equal to or lesser than a largest diameter of the assembled casing assembly 1021.

Figure 13:
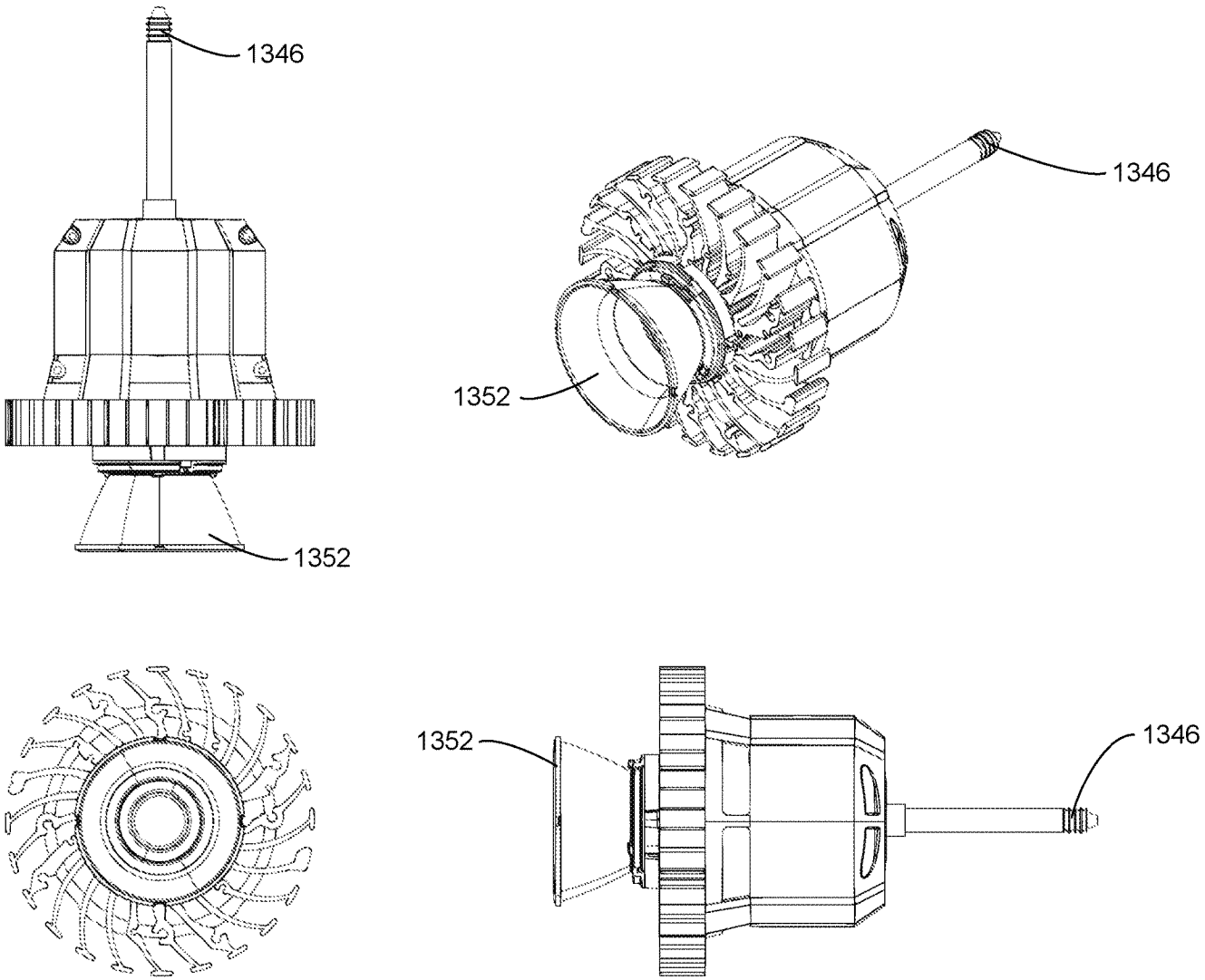

FIG. 13 shows views of a modular LED lamp system 1000, equipped with an elongate screw base 1346 and a reflector 1352. The elongate screw base 1346 can be an E11 screw base, an E12 screw base, or any other screw base. The elongate screw base 1346 can be an electrical power connection, and can attach or be coupled to the electrical connection mounting plate 1018. A length of the elongate screw base 1346 can be determined based on a recess for an existing fixture. For example, if the modular LED lamp system 1000 is configured to replace the existing fixture in a retrofit application, then a total length of the LED lamp system 1000 can be determined to be the same as the depth of the recess. Alternatively, the total length of the LED lamp system 1000 can be determined such that all or most of the LED lamp system 1000 fits within the recess. Accordingly, the length of the elongate screw base 1346 can be determined based on a depth of an existing recess, a length of the basic LED lamp system 1000, and a length of the reflector 1352.

The reflector 1352 can be coupled to the LED optics holder, and can be considered part of the LED optics assembly 1015. The reflector 1352 can be conical or any other reflector shape, and can use PMMA (poly (methyl methacrylate))-based, silicone-based, or TIR (total internal reflection)-based optics, or aluminum, glass, or anti-reflective glass-based optics.

Figure 14:
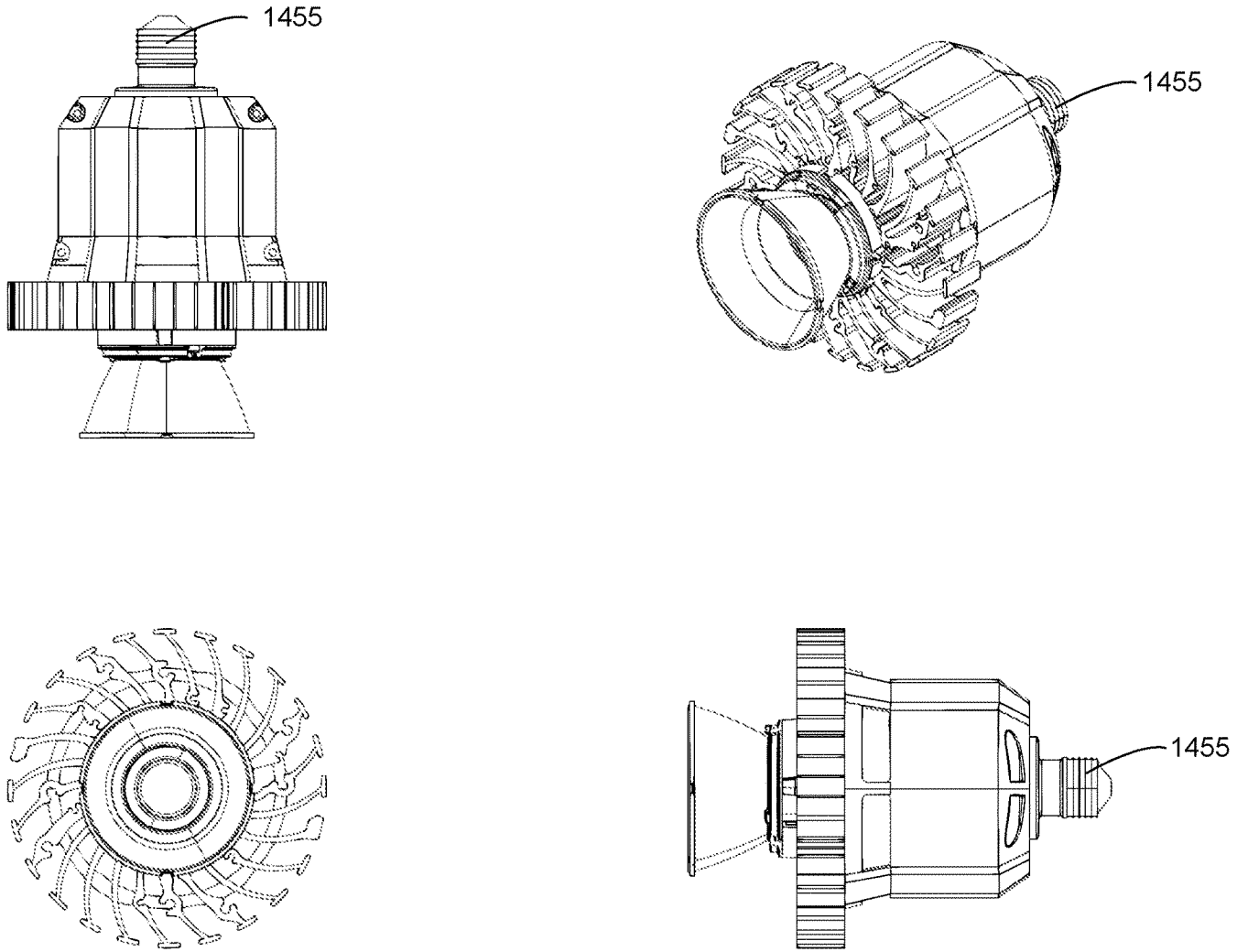

FIG. 14 shows views of a modular LED lamp system 1000, equipped with a screw base 1455 and a reflector. The reflector can be similar to the reflector 1352. The screw base 455 can be an E11 screw base, an E12 screw base, or any other screw base as described. The screw base 1455 can be an electrical power connection, and can attach or be coupled to the electrical connection mounting plate 1018. As with the elongate screw base 1346, the screw base 1455 can be chosen based on a recess for an existing fixture. For example, if the modular LED lamp system 1000 is configured to replace the existing fixture in a retrofit application, then a total length of the LED lamp system 1000 can be determined to be the same as the depth of the recess. Alternatively, the total length of the LED lamp system 1000 can be determined such that all or most of the LED lamp system 1000 fits within the recess, for example, so that a trim plate or another aesthetic features properly mounts over a face of the recess.

Figure 15:
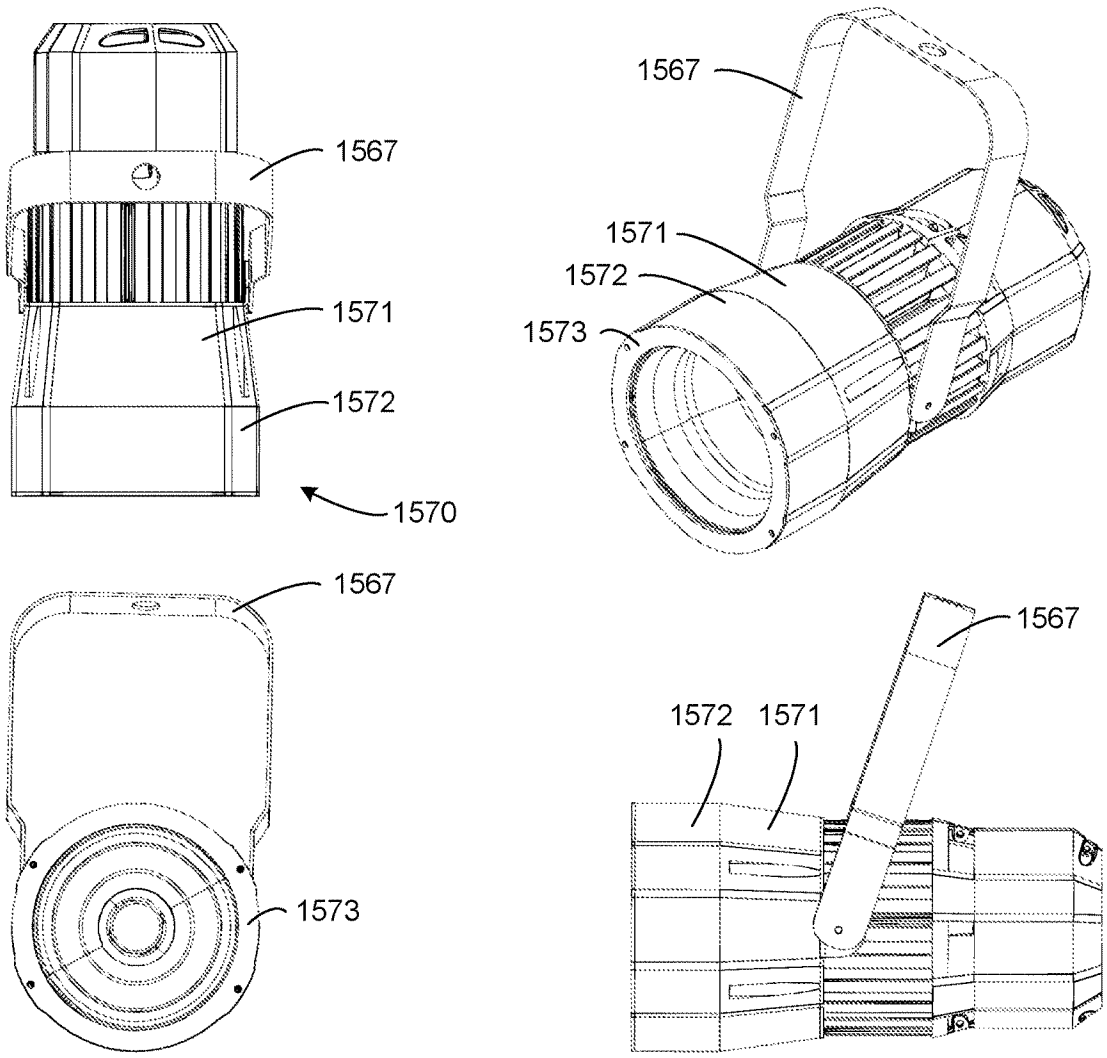

FIG. 15 shows views of a modular LED lamp system 1000, equipped with a yoke mount 1567 and an accessory adapter assembly 1570. The yoke mount 1567 can be similar to that discussed in FIG. 9 with relation to the LED lamp system 100. The accessory adapter assembly 1570 can include a long accessory shroud that includes a short accessory shroud 1571, a shroud extension 1572, and a cover 1573. The cover 1573 can be an aesthetic cover, and/or can be an accessory holder for the accessories discussed above, including top hats, half hats, louvres, honeycomb filters, gel filters, and barndoors.

Figure 16:
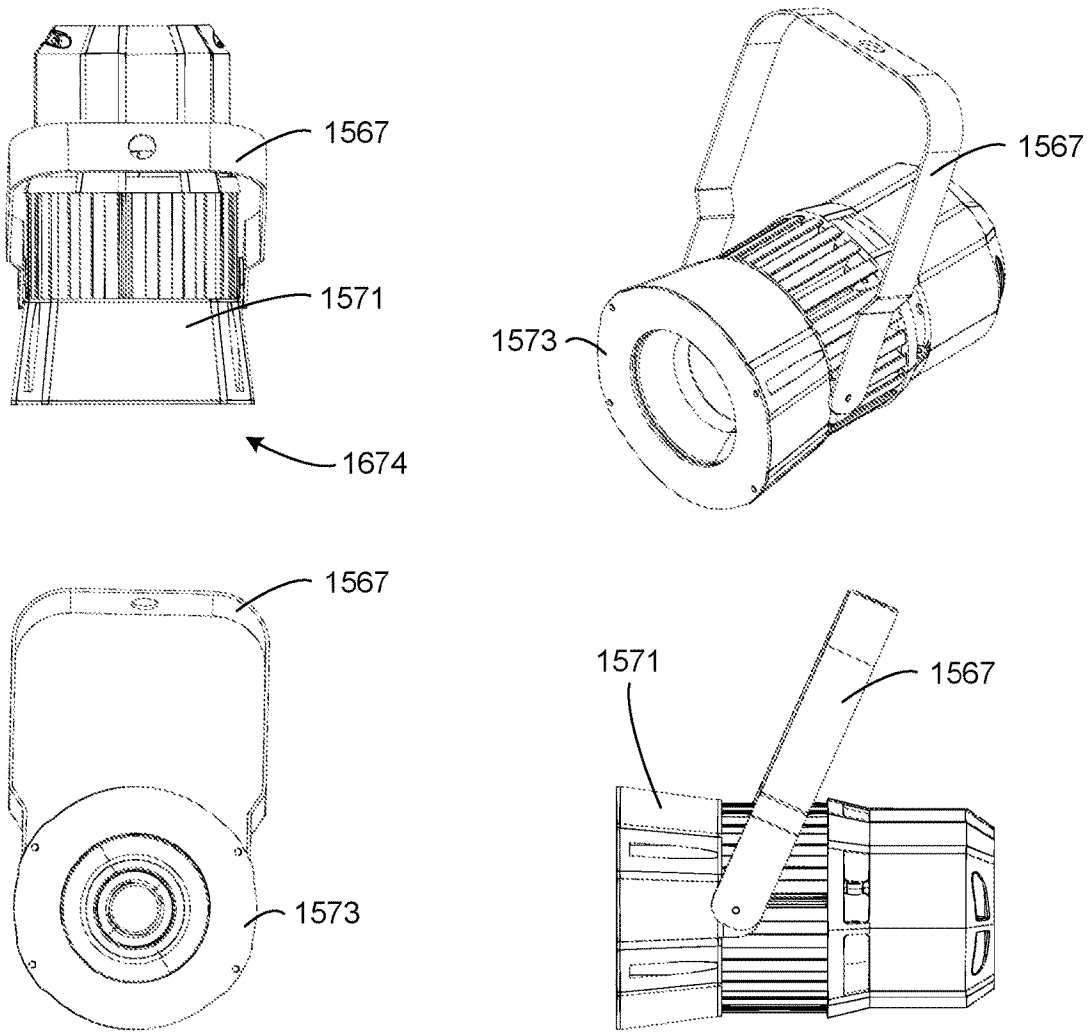

FIG. 16 shows views of a modular LED lamp system 1000, equipped with a yoke mount and an accessory adapter assembly 1674. The yoke mount can be similar to that discussed further in FIG. 9. The accessory adapter assembly 1570 can include a short accessory shroud 1571 and the cover 1573, as discussed above for FIG. 15.

Embodiments of the present disclosure can also be described through the following clauses:

Clause 1. A lamp system, comprising: a light-emitting diode (LED) unit comprising at least one LED; a heat dissipation assembly, the LED unit being coupled to an anterior portion of the heat dissipation assembly; an LED driver assembly comprising an LED driver unit and a driver mounting plate, wherein the LED driver unit is electrically coupled with the LED unit; an electrical connection mounting plate; and a casing assembly comprising a first longitudinal half and a second longitudinal half, wherein each of the first longitudinal half and the second longitudinal half comprise: a first indent that holds a posterior portion of the heat dissipation assembly, a second indent that holds the driver mounting plate, and a third indent that holds the electrical connection mounting plate.

Clause 2. The lamp system of clause 1, further comprising a lamp base coupled to the electrical connection mounting plate, wherein the lamp base is at least one of a bayonet base, a prong base, or a screw base.

Clause 3. The lamp system of any one of clauses 1 or 2, wherein lamp wiring is guided through at least one hole in the electrical connection mounting plate.

Clause 4. The lamp system of any one of clauses 1 through 3, wherein the casing assembly maintains a thermal barrier between the heat dissipation assembly and the LED driver assembly.

Clause 5. The lamp system of any one of clauses 1 through 4, further comprising a trim plate coupled to an anterior portion of the heat dissipation assembly, wherein the trim plate comprises a planar member, wherein an outer edge of the trim plate is substantially circular.

Clause 6. The lamp system of any one of clauses 1 through 5, wherein the LED driver unit comprises dimmer circuitry.

Clause 7. The lamp system of any one of clauses 1 through 6, further comprising an optics assembly comprising: an optics holder coupled to an anterior portion of the heat dissipation assembly, the optics holder securing the LED unit within a recessed portion of the heat dissipation assembly; and a light reflector coupled to an anterior portion of the optics holder.

Clause 8. The lamp system of any one of clauses 1 through 8, wherein the heat dissipation assembly comprises a heat sink, and a fan assembly posterior to the heat sink, wherein the first indent holds a portion of the fan assembly.

Clause 9. The lamp system of any one of clauses 1 through 8, wherein the heat dissipation assembly comprises a heat sink and a mounting plate posterior to the heat sink, wherein the first indent holds the mounting plate.

Clause 10. The lamp system of any one of clauses 1 through 9, wherein the heat dissipation assembly comprises a fan assembly, and the casing assembly comprises at least one ventilation hole between the fan assembly and the LED driver assembly.

Clause 11. An apparatus, comprising: a light-emitting diode (LED) unit comprising at least one LED; a heat dissipation assembly; an LED driver assembly comprising an LED driver unit and a driver mounting plate, wherein the LED driver unit is electrically coupled with the LED unit; and a casing assembly that secures the heat dissipation assembly a fixed distance anterior to the LED driver assembly, the casing assembly comprising a first longitudinal section and a second longitudinal section, wherein casing assembly provides an engineering fit around the driver mounting plate and at least a portion of the heat dissipation assembly based on the first longitudinal section being coupled to the second longitudinal section.

Clause 12. The apparatus of clause 11, further comprising an electrical connection mounting plate, wherein the casing assembly secures the LED driver assembly anterior to the electrical connection mounting plate, and the casing assembly further provides an engineering fit around the electrical connection mounting plate.

Clause 13. The apparatus of any one of clauses 11 or 12, further comprising a screw base coupled to the electrical connection mounting plate.

Clause 14. The apparatus of any one of clauses 11 through 13, wherein lamp wiring is guided through at least one hole in the electrical connection mounting plate.

Clause 15. The apparatus of any one of clauses 11 through 14, wherein the casing assembly maintains a thermal barrier between the heat dissipation assembly and the LED driver assembly.

Clause 16. The apparatus of any one of clauses 11 through 15, further comprising a trim plate coupled to an anterior portion of the heat dissipation assembly, wherein the trim plate comprises a planar member comprising a substantially circular outer circumference.

Clause 17. The apparatus of any one of clauses 11 through 16, further comprising a trim plate assembly comprising: a first planar member coupled to an anterior portion of the heat dissipation assembly, wherein at least a portion of an outer circumference of the first planar member is curved with a particular radius of curvature; a plurality of spacing members; and a secondary planar member connected to the first planar member using the spacing members, the second planar member comprising a substantially circular outer circumference and a substantially circular inner circumference.

Clause 18. The apparatus of any one of clauses 11 through 17, further comprising an optics assembly comprising: an optics holder coupled to an anterior portion of the heat dissipation assembly, the optics holder securing the LED unit within a recessed portion of the heat dissipation assembly; and a light reflector coupled to an anterior portion of the optics holder.

Clause 19. The apparatus of any one of clauses 11 through 18, wherein the casing assembly comprises at least one ventilation hole between the fan assembly and the LED driver assembly.

Clause 20. The apparatus of any one of clauses 11 through 19, further comprising a yoke mount assembly comprising: a yoke mount adapter comprising a face coupled to an anterior portion of the heat dissipation assembly, a first tab that extends perpendicular to the face, and a second tab that extends perpendicular to the face and parallel to the first tab; and a yoke coupled to the first tab and the second tab.

It is to be understood that the present invention is not limited to the embodiments described above, but encompasses any and all embodiments within the scope of the following claims.

We claim:

1. A lamp system, comprising:

a light-emitting diode (LED) unit comprising at least one LED;

a heat dissipation assembly, the LED unit being coupled to an anterior portion of the heat dissipation assembly;

an LED driver assembly comprising an LED driver unit and a driver mounting plate, wherein the LED driver unit is electrically coupled with the LED unit, wherein the LED driver unit comprises dimmer circuitry;

an electrical connection mounting plate; and a casing assembly comprising a first longitudinal half and a second longitudinal half, wherein each of the first longitudinal half and the second longitudinal half comprise: a first indent that holds a posterior portion of the heat dissipation assembly, a second indent that holds the driver mounting plate, and a third indent that holds the electrical connection mounting plate.

2. The lamp system of claim 1, further comprising a lamp base coupled to the electrical connection mounting plate, wherein the lamp base is at least one of a bayonet base, a prong base, or a screw base.

3. The lamp system of claim 1, wherein lamp wiring is guided through at least one hole in the electrical connection mounting plate.

4. The lamp system of claim 1, wherein the casing assembly maintains a thermal barrier between the heat dissipation assembly and the LED driver assembly.

5. The lamp system of claim 1, further comprising a trim plate coupled to an anterior portion of the heat dissipation assembly, wherein the trim plate comprises a planar member, wherein an outer edge of the trim plate is substantially circular.

6. The lamp system of claim 1, wherein the heat dissipation assembly comprises a heat sink and a mounting plate posterior to the heat sink, wherein the first indent holds the mounting plate.

7. The lamp system of claim 1, wherein the heat dissipation assembly comprises an active cooling assembly, and the casing assembly comprises at least one ventilation hole between the active cooling active cooling assembly and the LED driver assembly.

8. A lamp system, comprising:

a light-emitting diode (LED) unit comprising at least one LED;

a heat dissipation assembly, the LED unit being coupled to an anterior portion of the heat dissipation assembly;

an LED driver assembly comprising an LED driver unit and a driver mounting plate, wherein the LED driver unit is electrically coupled with the LED unit;

an electrical connection mounting plate;

a casing assembly comprising a first longitudinal half and a second longitudinal half, wherein each of the first longitudinal half and the second longitudinal half comprise: a first indent that holds a posterior portion of the heat dissipation assembly, a second indent that holds the driver mounting plate, and a third indent that holds the electrical connection mounting plate; and an optics assembly comprising:

an optics holder coupled to an anterior portion of the heat dissipation assembly, the optics holder securing the LED unit within a recessed portion of the heat dissipation assembly; and a light reflector coupled to an anterior portion of the optics holder.

9. A lamp system, comprising:

a light-emitting diode (LED) unit comprising at least one LED;

a heat dissipation assembly, the LED unit being coupled to an anterior portion of the heat dissipation assembly, wherein the heat dissipation assembly comprises a heat sink, and a fan assembly posterior to the heat sink;

an LED driver assembly comprising an LED driver unit and a driver mounting plate, wherein the LED driver unit is electrically coupled with the LED unit;

an electrical connection mounting plate; and a casing assembly comprising a first longitudinal half and a second longitudinal half, wherein each of the first longitudinal half and the second longitudinal half comprise: a first indent that holds a portion of the fan assembly, a second indent that holds the driver mounting plate, and a third indent that holds the electrical connection mounting plate.

10. An apparatus, comprising:

a light-emitting diode (LED) unit comprising at least one LED;

a heat dissipation assembly;

an LED driver assembly comprising an LED driver unit and a driver mounting plate, wherein the LED driver unit is electrically coupled with the LED unit;

a casing assembly that secures the heat dissipation assembly a fixed distance anterior to the LED driver assembly, the casing assembly comprising a first longitudinal section and a second longitudinal section, wherein the casing assembly provides an engineering fit around the driver mounting plate and at least a portion of the heat dissipation assembly based on the first longitudinal section being coupled to the second longitudinal section; and an electrical connection mounting plate, wherein the casing assembly secures the LED driver assembly anterior to the electrical connection mounting plate, and the casing assembly further provides an engineering fit around the electrical connection mounting plate.

11. The apparatus of claim 10, wherein the LED driver unit comprises dimmer circuitry.

12. The apparatus of claim 11, wherein lamp wiring is guided through at least one hole in the electrical connection mounting plate.

13. The apparatus of claim 10, further comprising a screw base coupled to the electrical connection mounting plate.

14. The apparatus of claim 10, wherein the casing assembly maintains a thermal barrier between the heat dissipation assembly and the LED driver assembly.

15. The apparatus of claim 10, further comprising a trim plate coupled to an anterior portion of the heat dissipation assembly, wherein the trim plate comprises a planar member comprising a substantially circular outer circumference.

16. An apparatus, comprising:

a light-emitting diode (LED) unit comprising at least one LED;

a heat dissipation assembly;

an LED driver assembly comprising an LED driver unit and a driver mounting plate, wherein the LED driver unit is electrically coupled with the LED unit;

a casing assembly that secures the heat dissipation assembly a fixed distance anterior to the LED driver assembly, the casing assembly comprising a first longitudinal section and a second longitudinal section, wherein the casing assembly provides an engineering fit around the driver mounting plate and at least a portion of the heat dissipation assembly based on the first longitudinal section being coupled to the second longitudinal section; and a trim plate assembly comprising:

a first planar member coupled to an anterior portion of the heat dissipation assembly, wherein at least a portion of an outer circumference of the first planar member is curved with a particular radius of curvature;

a plurality of spacing members; and a secondary planar member connected to the first planar member using the spacing members, the second planar member comprising a substantially circular outer circumference and a substantially circular inner circumference.

17. An apparatus, comprising:

a light-emitting diode (LED) unit comprising at least one LED;

a heat dissipation assembly;

an LED driver assembly comprising an LED driver unit and a driver mounting plate, wherein the LED driver unit is electrically coupled with the LED unit;

a casing assembly that secures the heat dissipation assembly a fixed distance anterior to the LED driver assembly, the casing assembly comprising a first longitudinal section and a second longitudinal section, wherein the casing assembly provides an engineering fit around the driver mounting plate and at least a portion of the heat dissipation assembly based on the first longitudinal section being coupled to the second longitudinal section; and an optics assembly comprising:

an optics holder coupled to an anterior portion of the heat dissipation assembly, the optics holder securing the LED unit within a recessed portion of the heat dissipation assembly; and a light reflector coupled to an anterior portion of the optics holder.

18. The apparatus of claim 10, wherein the casing assembly comprises at least one ventilation hole between an active cooling assembly and the LED driver assembly.

19. The apparatus of claim 10, further comprising a yoke mount assembly comprising:

a yoke mount adapter comprising a face coupled to an anterior portion of the heat dissipation assembly, a first tab that extends perpendicular to the face, and a second tab that extends perpendicular to the face and parallel to the first tab; and a yoke coupled to the first tab and the second tab.

20. The apparatus of claim 10, wherein an optics holder coupled to an anterior portion of the heat dissipation assembly secures the LED unit.

* * * * *